US008167157B2

(12) United States Patent
Shalomoff

(10) Patent No.: US 8,167,157 B2
(45) Date of Patent: May 1, 2012

(54) ASSEMBLY OF PANELS FOLDABLE TO FORM A CONTAINER

(75) Inventor: Ziva Shalomoff, New York, NY (US)

(73) Assignees: Ziva Shalomoff, Teaneck, NJ (US); Llora Kirsch, Teaneck, NJ (US)

( * ) Notice: Subject to any disclaimer, the term of this patent is extended or adjusted under 35 U.S.C. 154(b) by 1122 days.

(21) Appl. No.: 11/869,198

(22) Filed: Oct. 9, 2007

(65) Prior Publication Data

US 2009/0090709 A1 Apr. 9, 2009

(51) Int. Cl.
*B65D 6/00* (2006.01)
*B65D 30/10* (2006.01)
*B65D 8/00* (2006.01)

(52) U.S. Cl. ..... 220/4.28; 220/9.1; 220/4.08

(58) Field of Classification Search ..... 220/9.1–9.3, 220/4.28, 4.33, 4.08, 4.09, 4.16, 4.22, 4.23, 220/4.26, 4.31, 6, 7, 62, 652; 229/198.1
See application file for complete search history.

(56) References Cited

U.S. PATENT DOCUMENTS

| | | | | |
|---|---|---|---|---|
| 2,411,121 | A * | 11/1946 | Wilson | 217/5 |
| 3,114,453 | A * | 12/1963 | Rosenthal | 229/162.4 |
| 4,010,865 | A * | 3/1977 | Wilgus | 220/6 |
| 4,449,662 | A * | 5/1984 | Okamura et al. | 229/192 |
| 4,709,812 | A | 12/1987 | Kosterka | |
| 5,038,953 | A | 8/1991 | Radar | |
| 5,292,060 | A * | 3/1994 | Focke et al. | 229/198.1 |
| 5,494,161 | A * | 2/1996 | Herbst | 206/425 |
| 6,006,918 | A | 12/1999 | Hart | |
| 6,142,365 | A * | 11/2000 | Breitbach | 229/198.2 |
| 6,401,995 | B1 * | 6/2002 | Yuille et al. | 224/404 |
| 6,427,906 | B2 | 8/2002 | Grueneberg | |
| 6,688,516 | B1 | 2/2004 | Ussen | |
| 6,799,691 | B2 * | 10/2004 | Wincent | 220/4.33 |
| 6,840,436 | B2 | 1/2005 | Wang | |
| 7,152,751 | B2 * | 12/2006 | Bartasevich et al. | 220/6 |
| 7,314,147 | B2 * | 1/2008 | DeCarlo et al. | 220/6 |
| 7,597,209 | B2 * | 10/2009 | Rothschild et al. | 220/23.87 |
| 2002/0092787 | A1 * | 7/2002 | Cheng | 206/459.5 |
| 2004/0112895 | A1 * | 6/2004 | Bartasevich et al. | 220/4.28 |
| 2007/0056970 | A1 * | 3/2007 | Scherer et al. | 220/62.22 |

FOREIGN PATENT DOCUMENTS

JP 2003-289737 10/2003

OTHER PUBLICATIONS

Patterson Kazakhstan LLC, "Semi-automatic Foldable Toy Box", Alibaba.com, (2 pages).

IPtech International, Inc., "Trinket Batay-Box, (Semi-automatic foldable Trinket Box)", Iptech.biz, (2 pages).

* cited by examiner

*Primary Examiner* — Bryon Gehman
*Assistant Examiner* — Shawn Braden
(74) *Attorney, Agent, or Firm* — Fish & Richardson P.C.

(57) ABSTRACT

A box is collapsible in such a manner that it can form a flat stack of panels, each of which corresponds to one side of the box. When the box is configured as a flat stack of panels, it is relatively compact and, therefore, easy to store. When the collapsible box is configured as a box, it is sturdy and strong. The collapsible box has latching elements that can temporarily connect adjacent sides of the box to one another. Typically, a person can latch and unlatch the latching elements with his or her hand. The box is typically transparent and, therefore, well suited for displaying ornamental items, such as ornate hats.

20 Claims, 12 Drawing Sheets

ASSEMBLY OF PANELS FOLDABLE TO FORM A CONTAINER

TECHNICAL FIELD

This disclosure relates to an assembly of panels that is foldable to form a container.

BACKGROUND

Boxes are used for a variety of purposes. One such purpose includes storing hats. Hat boxes generally protect hats from the environment surrounding them. Some hat boxes are decorative as well. Boxes also may be used to store a variety of other items.

SUMMARY

The present disclosure relates to a box that is collapsible in such a manner that it can form a flat stack of panels, each of which corresponds to one side of the box. The collapsible box's configuration can easily be changed from a box configuration to a flat stack-of-panels configuration. When the collapsible box is configured as a flat stack of panels, it is relatively compact and, therefore, easy to store. When the collapsible box is configured as a box, it is sturdy and strong.

The collapsible box includes latching elements that may be either eyelets, magnets, adhesive material, velcro, etc. The latching elements operate to temporarily connect adjacent sides of the box to one another. Typically, a person can latch and unlatch the latching elements with his or her hand. Therefore, configuring the box and collapsing the box is easy to do.

Moreover, the collapsible box is typically transparent. Therefore, the collapsible box is ideal for displaying ornamental items, such as ornate hats and the like.

In one aspect, an assembly of panels is foldable to form a container. The assembly of panels may also be foldable to form a substantially flat stack of panels. The assembly includes a bottom panel with four edges and side panels. Each side panel also has four edges. One edge of at least some of the side panels is connected to a respective one of the bottom panel edges. A top panel has four edges. One of the top panel edges is connected to one of the side panels at a side panel edge opposite the side panel edge that is connected to the bottom panel. Respective latching elements are at some of the side panel edges. Each latching element can be hand manipulated to engage an edge of a different side panel when the assembly of panels is folded to form the container.

In some implementations, once engaged, each latching element can be further hand manipulated to disengage a respective edge of a different side panel. Typically, each latching element, when engaged to a corresponding edge of a different side panel, maintains a configuration between the side panel edge with the latching element and the different side panel.

Certain embodiments include substantially rigid frames, each of which defines a respective substantially rectangular interior region and each of which corresponds to an associated one of the bottom, top or side panels. A material spans across each interior region defined by the respective frames. Flexible connectors connect the side panels to the bottom panel and connect the top panel to one of the side panels.

According to some embodiments, the frames are metallic. The material spanning across each interior region defined by the respective frames can be a vinyl polymer, such as pvc. Typically, the vinyl polymer material is wrapped around the frames and adhered to itself by applying heat to the vinyl polymer. The material spanning across each interior region defined by the respective frames is usually substantially transparent. The flexible connectors typically are made of a vinyl polymer material.

In certain implementations, each latching element is adapted to frictionally engage the edge of the different side panel when the assembly of panels is folded to form the container. The latching elements can include one or more eyelets.

In some embodiments, the latching elements are magnets that may be adapted to magnetically engage an edge of the respective side panel when the assembly of panels is folded to form the container.

Some implementations include a latching element on the top panel to engage an edge of a side panel. A side panel may be connected to a far edge of the top panel relative to the bottom panel.

In another aspect, an assembly of panels that is foldable to form a container includes a bottom panel with four edges and side panels, each of which has four edges. One edge of at least some of the side panels is connected to a respective one of the bottom panel edges. A top panel has four edges. One of the top panel edges is connected to an edge of one of the side panels opposite the side panel edge that is connected to the bottom panel. Flexible connectors connect the side panels to the bottom panel and connecting the top panel to at least one of the side panels. Each of the bottom panel, top panel and side panels respectively includes a substantially rigid frame defining a substantially rectangular interior region and a substantially transparent material spanning across each interior region. The frame of at least some of the side panels includes a latching element that can be hand manipulated to engage an edge of another side panel when the assembly of panels is folded to form the container. Engagement of the latching element to an edge of another side panel creates an audible click.

According to yet another aspect, an assembly of panels that is foldable to form a container includes a bottom panel with four edges and side panels, each of which has four edges. One edge of at least some of the side panels is connected to a respective one of the bottom panel edges. A top panel has four edges, one of which is connected to an edge of one of the side panels opposite the side panel edge that is connected to the bottom panel. Flexible connectors connect the side panels to the bottom panel and connecting the top panel to at least one of the side panels. Each of the bottom panel, top panel and side panels respectively include a substantially rigid frame defining a substantially rectangular interior region and a substantially transparent material spanning across each interior region. The frames of at least some of the side panels and the top panel include a latching element that can be hand manipulated to engage an edge of a side panel when the assembly of panels is folded to form the container. Engagement of the latching element to an edge of a side panel creates an audible click. Once engaged, each latching element can be hand manipulated disengage the respective edge of a side panel. Each latching element is an eyelet that extends from its respective side panel or top panel in a direction that is substantially perpendicular to the plane of the panel from which it extends.

In some implementations, one or more of the following advantages may be realized.

For example, an assembly of panels may be provided that easily can be configured to form a sturdy container or, alternatively a relatively compact stack of panels. If the assembly of panels is configured to form a container, that container is sturdy and well suited to store, for example, hats. If the assembly of panels is configured as a relatively compact stack of panels, then it takes up very little space. In such a configuration, multiple stacks of panels can be stacked upon one another. Accordingly, configuring the assembly of panels as a relatively compact stack of panels makes them particularly well suited for being stored or shipped, where space constraints are typically an important consideration. The assembly of panels is relatively inexpensive and simple to manufacture.

Terms such as, "top", "bottom", "side", "upper", "lower", etc. are used for convenience to describe the relative positions of various elements if the container is in an upright orientation. However, depending on how a container is actually orientated, the "upper" panel could be below the "lower panel," and a "side" panel could be above or below another "side" panel.

The details of one or more embodiments of the invention are set forth in the accompanying drawings and the description below. Other features and advantages of the invention will be apparent from the description and drawings, and from the claims.

DETAILED DESCRIPTION

A box is collapsible in such a manner that it can form a flat stack of panels, each of which corresponds to one side of the box. The collapsible box's configuration can easily be changed from a box configuration to a flat stack-of-panels configuration. When the collapsible box is configured as a flat stack of panels, it is relatively compact and, therefore, easy to store. When the collapsible box is configured as a box, it is sturdy and strong.

The collapsible box includes latching elements that may be either eyelets, magnets, adhesive material, velcro, etc. The latching elements operate to temporarily connect adjacent sides of the box to one another. Typically, a person can latch and unlatch the latching elements with his or her hand. Therefore, configuring the box and collapsing the box is easy to do.

Moreover, the collapsible box is typically transparent. Therefore, the collapsible box is ideal for displaying ornamental items, such as ornate hats and the like.

Figure 1:
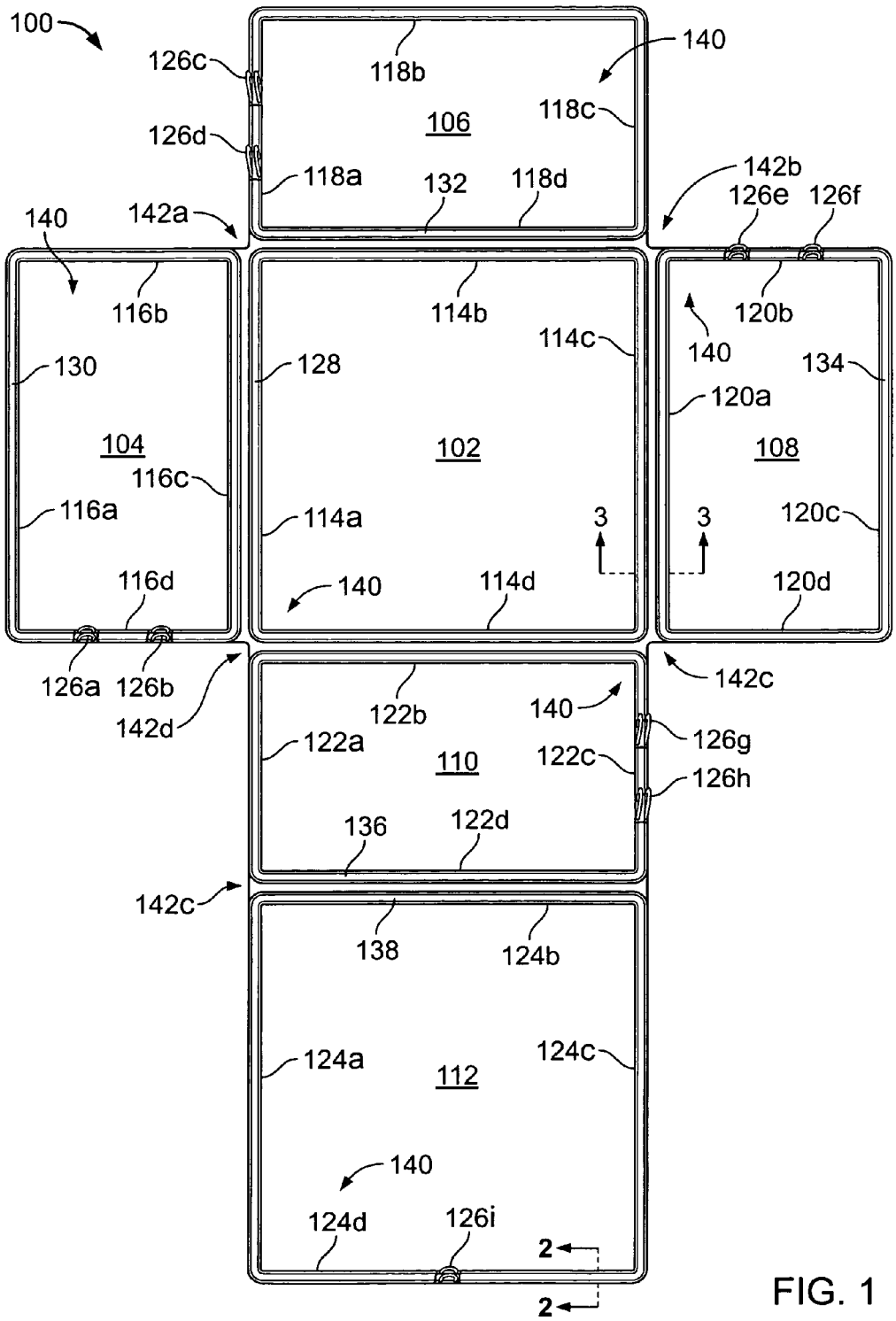
FIG. 1 is a plan view of an assembly of panels that is foldable to form a container.

FIG. 1 is a plan view of an example of an assembly 100 of panels that is foldable to form a container (i.e., a collapsible box). The illustrated assembly 100 includes a bottom panel 102, four side panels 104, 106, 108, 110 and a top panel 112. Each panel is substantially rectangular and the bottom and top panels 102, 112 are substantially square. The bottom panel 102 has four edges 114*a*, 114*b*, 114*c*, 114*d*. Side panel 104 has four edges 116*a*, 116*b*, 116*c*, 116*d*. Side panel 106 has four edges 118*a*, 118*b*, 118*c*, 118*d*. Side panel 108 has four edges 120*a*, 120*b*, 120*c*, 120*d*. Side panel 110 has four edges 122*a*, 122*b*, 122*c*, 122*d*. The top panel 112 also has four edges 124*a*, 124*b*, 124*c*, 124*d*.

One edge of each side panel 104, 106, 108, 110 is connected to the bottom panel 102. For example, side panel edge 116*c* is connected to bottom panel edge 114*a*, side panel edge 118*d* is connected to bottom panel edge 114*b*, side panel edge 120*a* is connected to bottom panel edge 114*c* and side panel edge 122*b* is connected to bottom panel edge 114*d*.

Top panel edge 124*b* is connected to one of the side panels 110 at a side panel edge 122*d*, which is opposite the side panel 122*b* connected to the bottom panel 102.

Some of the panel edges have latching elements 126*a*-126*i*. For example, side panel edge 116*d* has two latching elements 126*a*, 126*b*, side panel edge 118*a* has two latching elements 126*c*, 126*d*, side panel edge 120*b* has two latching elements 126*e*, 126*f* and side panel edge 122*c* has two latching elements 126*g*, 126*h*. Top panel edge 124*d* has one latching element 126*i*.

The illustrated latching elements 126*a*-126*i* are eyelets that extend outward from edges of the respective panels. Each eyelet is bent slightly in a direction that facilitates frictional engagement with an edge of different side panel when the assembly 100 is folded into a container. Each latching elements is adapted to releasably engage a corresponding edge of another panel when the assembly of panels is configured as a container.

Typically, minimal force is required to frictionally engage an eyelet with a corresponding different panel edge. In most implementations, the requisite engagement force can be readily provided by a user pushing the eyelets and edges together with their fingers. Similarly, minimal force is typically required to disengage an eyelet with a corresponding edge of a different panel.

In some implementations, when folded to form a container, the eyelets engage panel edges in a manner that produces an audible click. In those instances, the click may indicate to a user that the eyelet and the corresponding panel edge have been engaged properly.

Once engaged, an eyelet and its corresponding different panel edge tend to maintain the relative positions of the engaged panels and inhibit movement of those panels relative to one another. The force required to disengage an engaged eyelet from an engaged panel edge is small. In some implementations, the requisite disengagement force can be readily provided by a person pulling the eyelet and the engaged panel away from each other using her fingers.

Each panel 102, 104, 106, 108, 110, 112 is formed from a substantially rigid frame 128, 130, 132, 134, 136, 138 and a material 140 that spans the interior region defined by the frame. In the illustrated implementations, the frames are metallic. As illustrated, the latching element 126*a*-126*i* are parts of the frames.

The material 140 that spans the interior region defined by each frame forms sides of the container when the assembly 100 is so configured. The material 140 that spans the interior regions at the bottom and top panels 102, 112 substantially form the bottom and top of the container when the assembly 100 is so configured. Frames 128 and 138 define substantially square regions. The material 140 that spans each region can be flexible and preferably is substantially transparent. In some implementations, the material 140 is a vinyl polymer, such as polyvinyl chloride (PVC).

Figure 2:
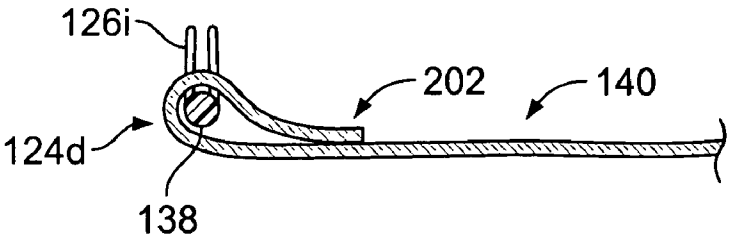
FIG. 2 is a cross-sectional view of a panel edge taken across lines 2-2 of FIG. 1.

FIG. 2 is a cross-sectional view of panel edge 124*d* taken across lines 2-2 in FIG. 1.

In the illustrated implementation, the material 140 that spans the region in the rectangular frame 138 is folded over the frame 138 at edge 124*d* and adhered to itself at 202. The material 140 may be adhered, for example, using an adhesive material. Alternatively, heat may be applied to the material 140 to fuse the sections of folded material together. Latching element 126*i*, which is part of frame 138, extends through an opening (not visible in FIG. 2) in the folded portion of the material 140.

As shown in FIG. 1, flexible connectors 142*a*, 142*b*, 142*c*, 142*d*, respectively, connect side panels 104, 106, 108, 110 to the bottom panel 102, and flexible connector 142*e* connects the top panel 112 to side panel 110. Each panel 102-112 can be rotated about the axis of corresponding flexible connectors 142*a*-142*e*, with almost 360 degrees of freedom. In some implementations, the flexible connectors 142*a*-142*e* are made of the same material as the material 140. The flexible connectors are flexible in that they allow adjacent side/bottom and top panels to move relative to one another.

Figure 3:
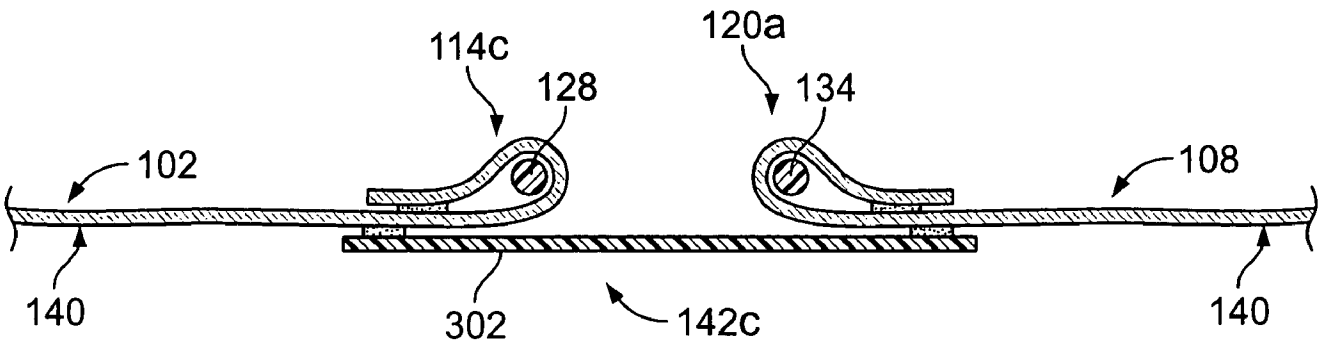
FIG. 3 is a cross-sectional view of a connector between adjacent panels taken across lines 3-3 in FIG. 1.

FIG. 3 is a cross-sectional view of connector 142*c* between bottom panel 102 and side panel 108 taken across lines 3-3 in FIG. 1.

The illustrated connector 142*c* includes a strip 302 of material (e.g., polyvinyl chloride or adhesive tape) that is adhered to the lower surface of bottom panel 102 at one end and to the lower surface of side panel 108 at the opposite end. In some implementations, the connector 142*c* is made of a vinyl polymer material. The connector 142*c* may be adhered to the panels using an adhesive material. Alternatively, the connector may be adhered to the panels by the application of heat to at least partially melt the strip 302, the bottom panel 102 and/or the side panel 108 to fuse those elements together.

Although in the illustrated example the strip 302 of material is adhered to the lower surfaces of the panels 102, 108, the strip 302 could, alternatively, be adhered to the upper surfaces of the panels 102, 108.

FIGS. 4A-4D illustrate a progression of perspective views showing an assembly 100 of panels being 100 being folded to form a container.

Figure 4A:
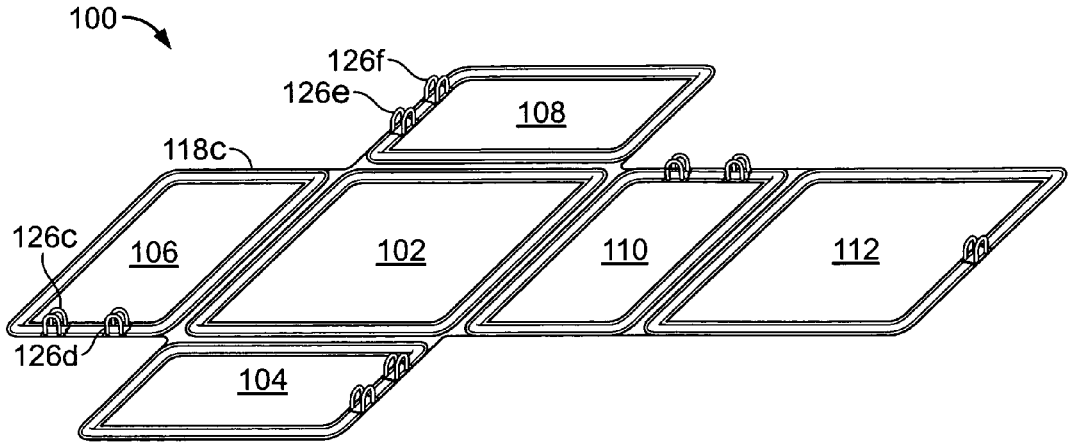
FIGS. 4A-4D are a progression of perspective views showing an assembly of panels being folded to form a container.

In FIG. 4A, the assembly 100 of panels is in a completely unfolded state. In that state, the assembly 100 is substantially flat.

Figure 4B:
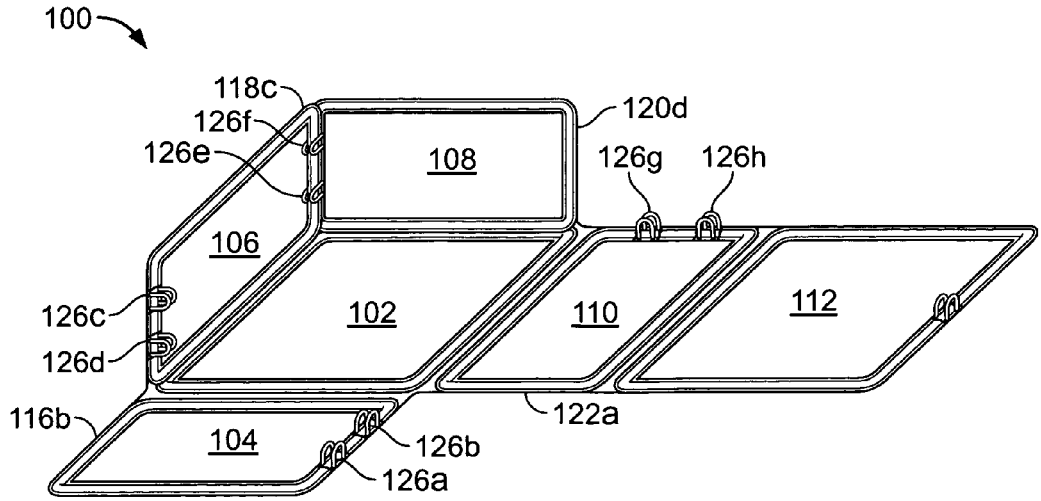

In FIG. 4B, side panels 106, 108 are folded up approximately 90 degrees relative to the plane of the bottom panel 102. With side panels 106, 108 so configured, latching elements 126*e*, 126*f* frictionally engage side panel edge 118*c*. The engagement between the latching elements 126*e*, 126*f* is such that panels 106, 108 are maintained in an orientation that is approximately (i.e., 90 degrees) orthogonal to the plane of bottom panel 102.

Figure 4C:
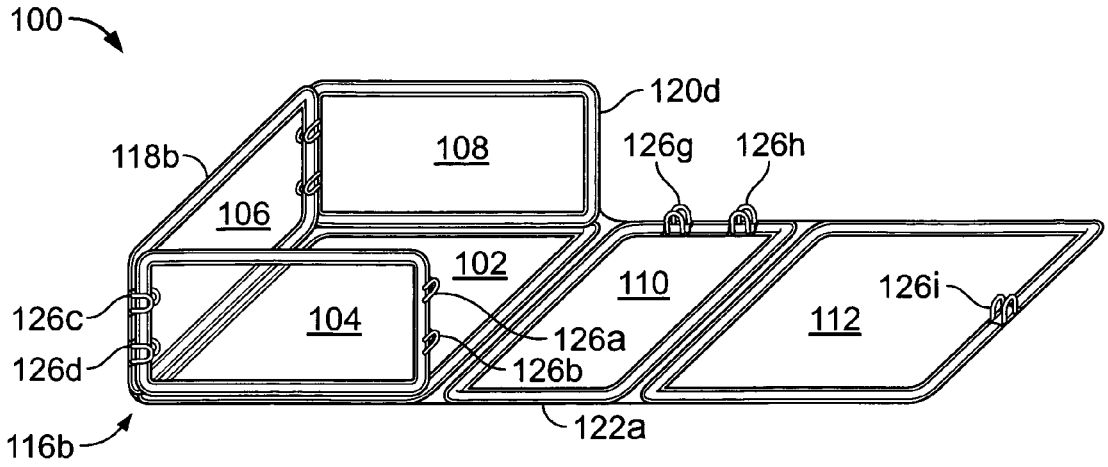

In FIG. 4C, side panel 104 is folded up approximately 90 degrees relative to the plane of the bottom panel 102. With side panel 104 so configured, latching elements 126*c*, 126*d* frictionally engage side panel edge 116*b*. The engagement between the latching elements 126*c*, 126*d* and side panel edge 116*b* facilitates maintaining panels 104 and 106 in an orientation that is approximately orthogonal (i.e., 90 degrees) to the plane of bottom panel 102.

Figure 4D:
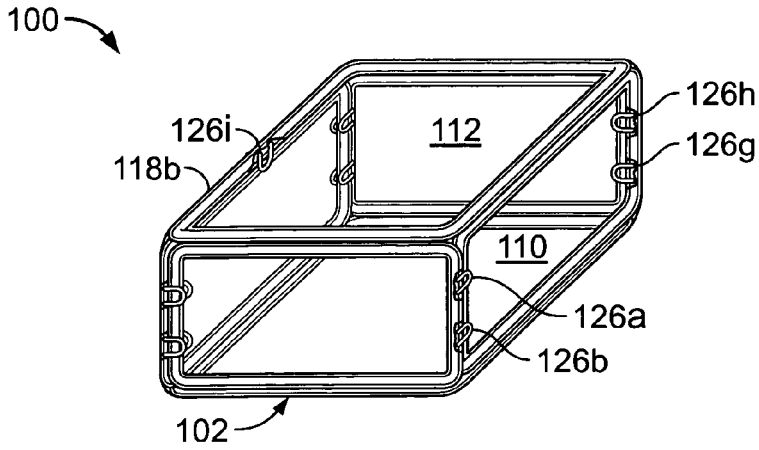

In FIG. 4D, side panel 110 is folded up approximately 90 degrees relative to the plane of the bottom panel 102, and the upper panel 112 is positioned directly above and substantially parallel to the bottom panel 102. With side panel 110 so configured, latching elements 126*g*, 126*h* frictionally engage side panel edge 120*d* and latching elements 126*a*, 126*b* frictionally engage side panel edge 122*a*. The engagement between the latching elements 126*g*, 126*h* and side panel 120*d* and the engagement between latching elements 126*g*, 126*h* and side panel edge 122*a* facilitate maintaining side panels 110, 108 and 104 in an orientation that is approximately orthogonal to the plane of the bottom panel 102.

With the upper panel 112 positioned directly above and substantially parallel to the bottom panel 102, latching element 126*i* engages side panel edge 118*b*. The engagement of latching element 126*i* and side panel edge 118*b* facilitates maintaining the upper panel 112 oriented directly above and substantially parallel to the bottom panel 102.

When the assembly 100 is configured as a container, latching element 126*i* easily can be disengaged from the side panel edge 118*b*. When latching element 126*i* is disengaged from the side panel edge 118*b*, the upper panel 112 can be swung open to enable a user to place an object (e.g., a hat) into the container or to take an object out of the container.

Figure 5:
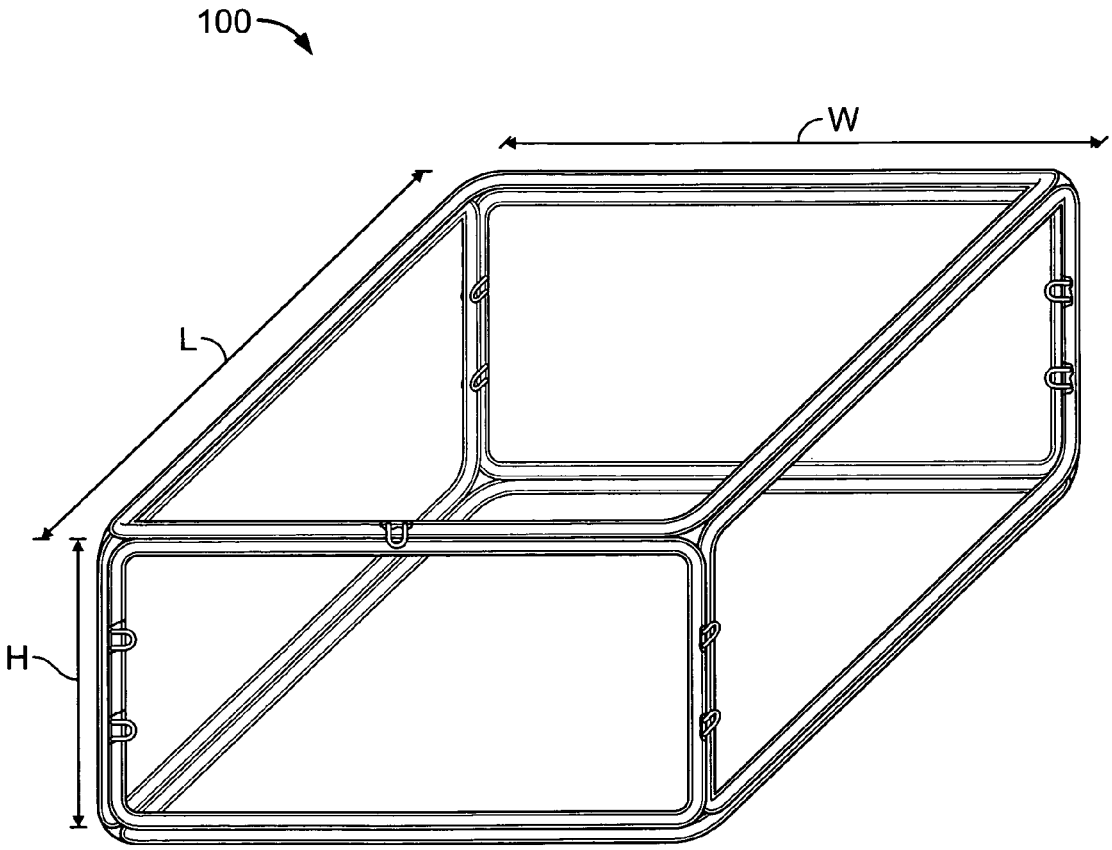
FIG. 5 is a perspective view of an assembly of panels configured as a container.

FIG. 5 is a perspective view of the assembly 100 of panels from FIG. 1 folded into a container.

The illustrated container has a height "H", a length "L" and a width "W". In some implementations, the height "H" is between approximately six and eight inches. In some implementations, the length "L" is between approximately ten and eighteen inches. In some implementations, the width "W" is between approximately ten and eighteen inches. In a particular implementation, the height is about 8 inches, and each of the length and width is about 14 inches.

In the illustrated implementation, the length "L" and width "W" have similar dimensions. However, in some implementations, those dimensions can differ from one another.

FIGS. 6A-6D is a progression of perspective views showing the assembly 100 of panels from FIG. 1 being folded to form a stack of panels. The stack of panels is relatively compact and, therefore, well suited for storing or shipping the assembly 100 of panels.

Figure 6A:
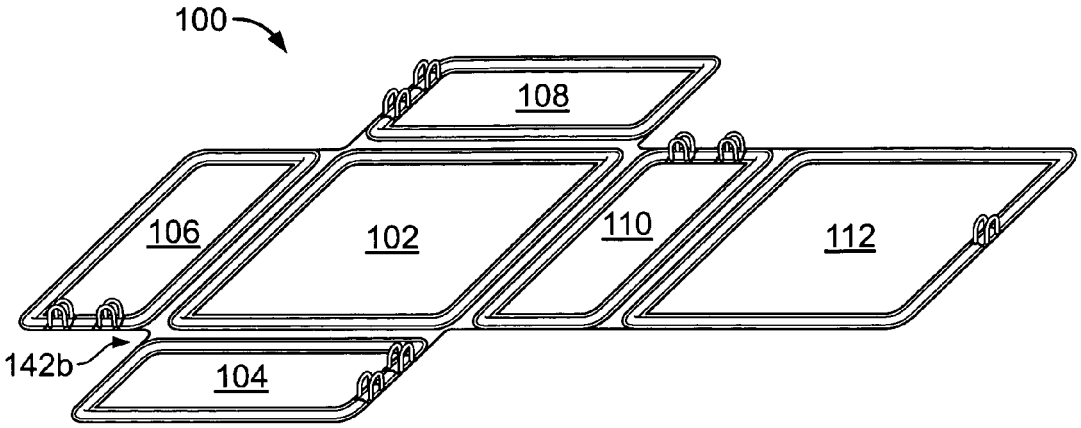
FIGS. 6A-6D are a progression of perspective views showing an assembly of panels being folded to form a stack of panels.
Figure 6B:
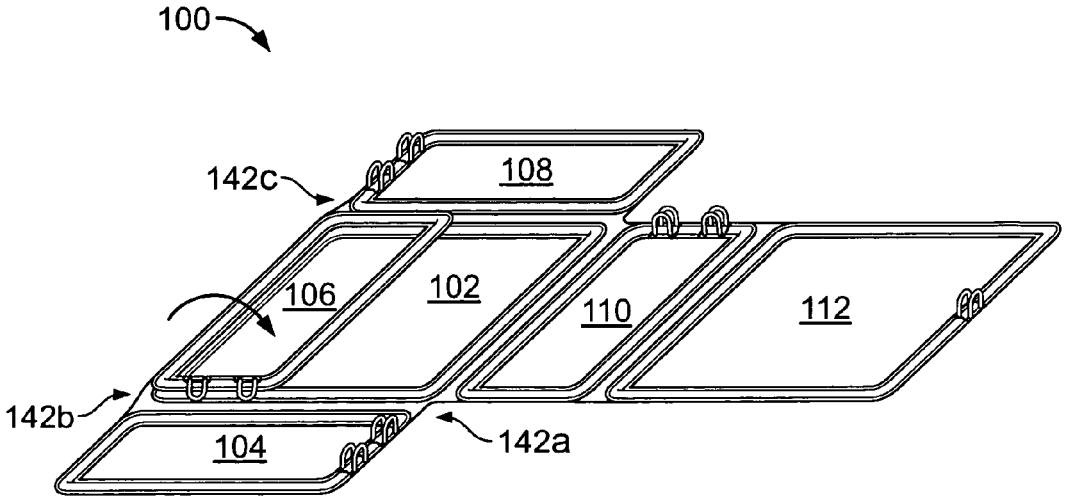
Figure 6C:
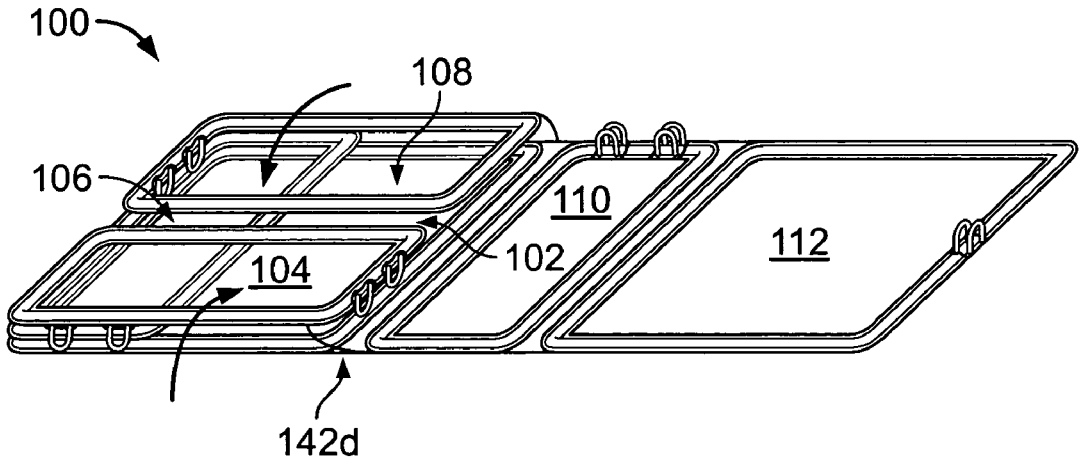
Figure 6D:
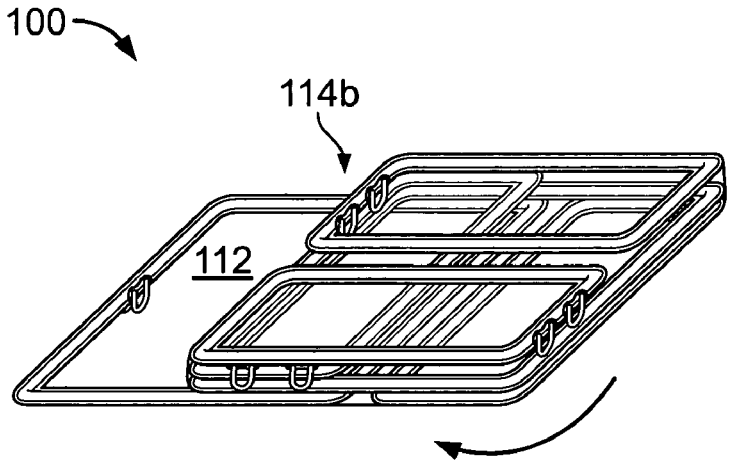

In FIG. 6A, the assembly 100 of panels is in a completely unfolded state. In that state, the assembly 100 is substantially flat. In FIG. 6B, side panel 106 is folded about connector 142*b* so that it lies atop a portion of bottom panel 102. In FIG. 6C, side panels 104 and 108 are folded about connectors 142*a*, 142*c*, respectively. Once folded in that manner, side panels 104 and 108 lie atop a portion of side panel 106 and bottom panel 102. In FIG. 6D side panel 110 and top panel 112 are folded about connector 142*d* so that they lie beneath the bottom panel 102. When folded in that manner, a portion of the top panel 112 extends beyond bottom panel edge 114*b*. In FIG. 6D, the assembly 100 of panels is shown folded into a relatively compact stack of panels.

Figure 7:
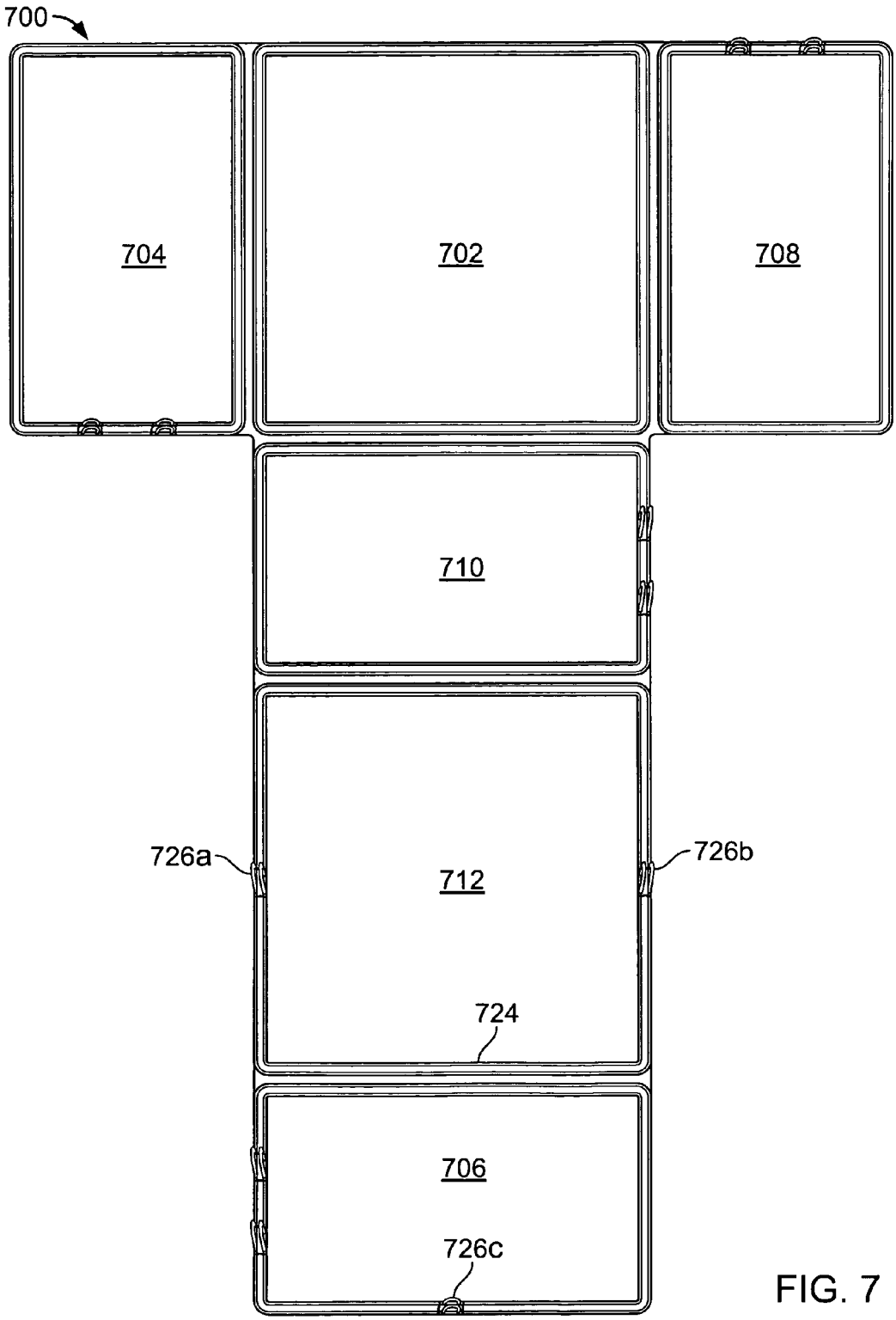
FIG. 7 is a plan view of another assembly of panels that is foldable to form a container.

FIG. 7 is a plan view of an another assembly 700 of panels that is foldable to form a container.

Although the illustrated assembly 700 is similar to the assembly 100 of FIG. 1 in some respects, it differs in other respects. For example, The relative arrangement of panels in FIG. 7 is different from the relative arrangement of panels in FIG. 1. In the assembly 700 of FIG. 7, only three side panels 704, 708, 710 are directly connected to bottom panel 702. The fourth side panel 706 is connected to the far edge 724 of the top panel 712 relative to the bottom panel 702.

Additionally, the arrangement of latching elements on the various panels in FIG. 7 differs somewhat from the arrangement of latching elements in FIG. 1. In FIG. 7, the top panel 712 has latching elements 726*a*, 726*b* on its opposite sides.

Those latching elements 726*a*, 726*b* are adapted to engage edges of panel 704 and 708, respectively, when the assembly 700 of panels is folded into the shape of a container.

Moreover, side panel 706 has an additional latching element 726*c* at its far edge relative to the top panel 712. Latching element 726*c* is adapted to engage an edge of bottom panel 702 when the assembly 700 of panels is configured as a container.

Figure 8:
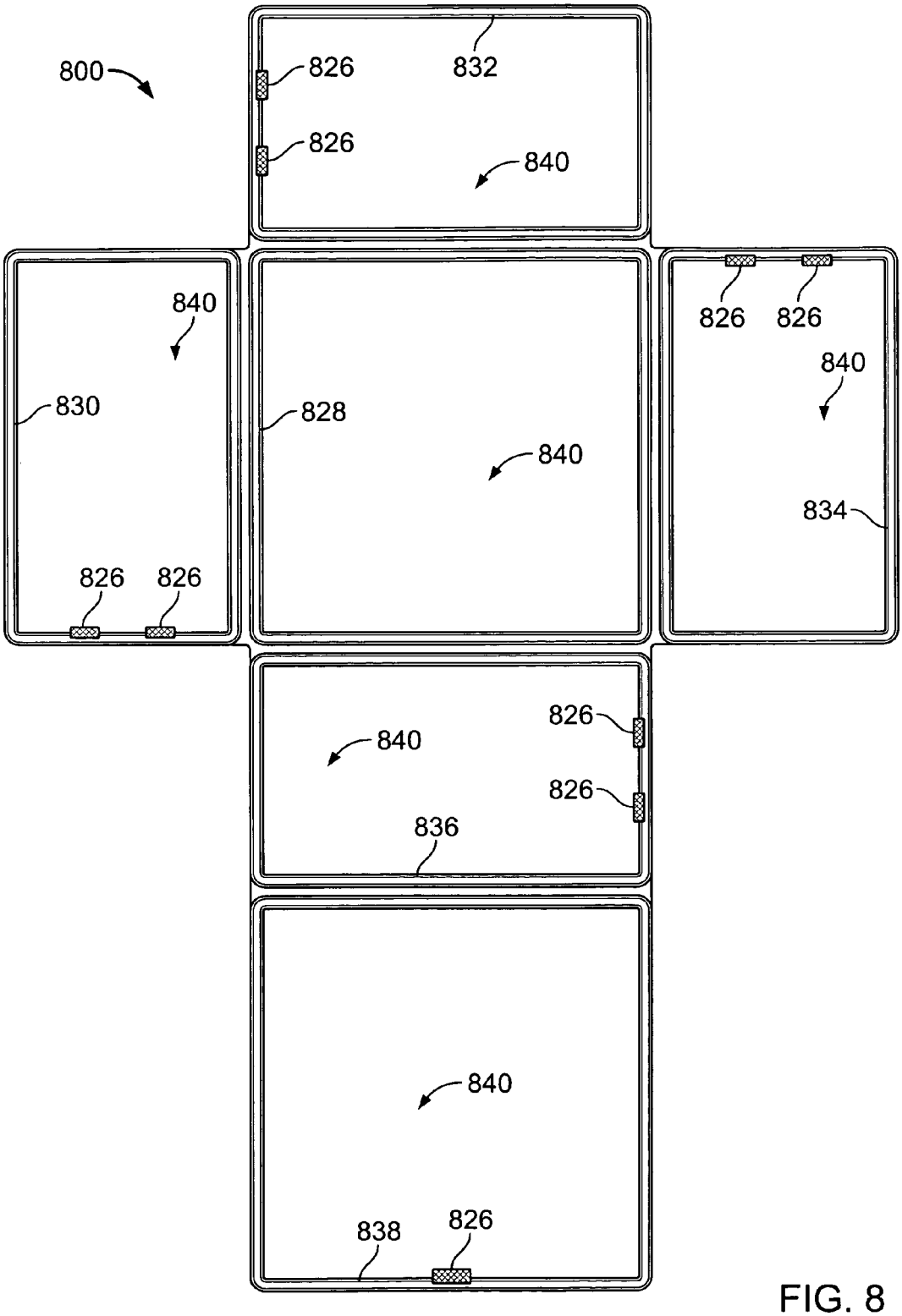
FIG. 8 is a plan view of yet another assembly of panels that is foldable to form a container.

FIG. 8 is a plan view of yet another assembly 800 of panels that is foldable to form a container.

The illustrated assembly 800 is similar in some respects to the assembly 100 of FIG. 1. In the assembly 800 of FIG. 8, however, the latching elements are magnets 826. In the illustrated implementation, the magnets 826 are adhered to the frames 828-832 and are enclosed in the vinyl material 840 that extends across each frame opening. The frames 828-838 may be made of a material that is attracted to the magnets. Accordingly, when the magnets 826 are positioned near an edge of a different panel, as happens when the assembly 800 is folded to form a container, the magnets can magnetically engage that edge. When a magnet 826 is magnetically engaged to an edge of a different panel, the magnetic force substantially maintains the positions of the engaged panels. Further movement of the engaged panels relative to one another is substantially inhibited.

In some implementations, the frames 828-832 are made from a material that is not attracted to the magnets 826. In those instances, a piece of magnetically attractive material can be adhered to the frames where a magnet can engage it.

The force required to engage and/or disengage corresponding panels in FIG. 8 is small. In most implementations, the requisite force can be readily provided by a person using her fingers.

Figure 9:
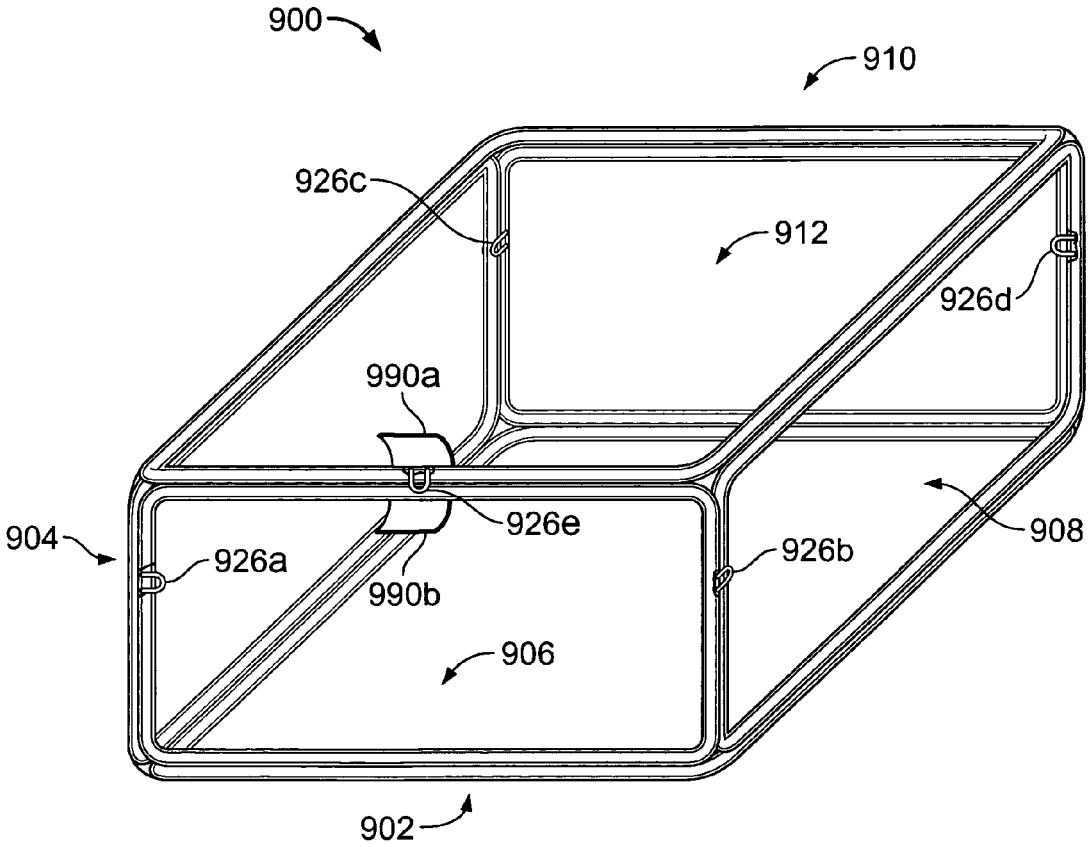
FIG. 9 is a perspective view of still another assembly of panels folded into a container.

FIG. 9 is a perspective view of still another assembly 900 of panels foldable to form a container. The illustrated assembly 900 is folded into a container.

The illustrated assembly 900 has a bottom panel 902, a top panel 912 and four side panels 904, 906, 908 and 910. Only two of the side panels (i.e., side panel 906 and side panel 910) in the illustrated implementation have latching elements 926*a*, 926*b*, 926*c*, 926*d* that extend from them. Those two side panels 906 and 910 form opposite sides of the container.

Latching elements 926*a* and 926*b* respectively originate at opposite edges of side panel 906. Both latching elements extend substantially toward an opposite side of the container from side panel 906, namely substantially toward side panel 910. Those latching elements 926*a* and 926*b* are arranged on their respective panels so that they can latch adjacent edges of side panels 904, 908, respectively, when the panels are configured as a container.

Similarly, latching elements 926*c* and 926*d* respectively originate at opposite edges of side panel 910. Both latching elements extend substantially toward an opposite side of the container from side panel 910, namely substantially toward side panel 906. Those latching elements 926*c* and 926*d* are arranged on their respective panels so that they can latch adjacent edges of side panels 904, 908, respectively, when the panels are configured as a container.

A latching element 926*e* is on the top panel 912. That latching element 926*e* extends substantially downward and is arranged so that it can engage an upper edge of side panel 906 when the panels are configured to form a container.

Gripping elements 990*a*, 990*b* are respectively coupled to the top panel 912 and the side panel 906 near the place where latching element 926*e* engages side panel 906. The gripping elements may be PVC or any other kind of material that a person could grip. The gripping elements enable a user to pull top panel 912 and side panel 906 away from each other to disengage them from one another. Once disengaged, the top panel 912 can be opened exposing the interior of the container.

Figure 10:
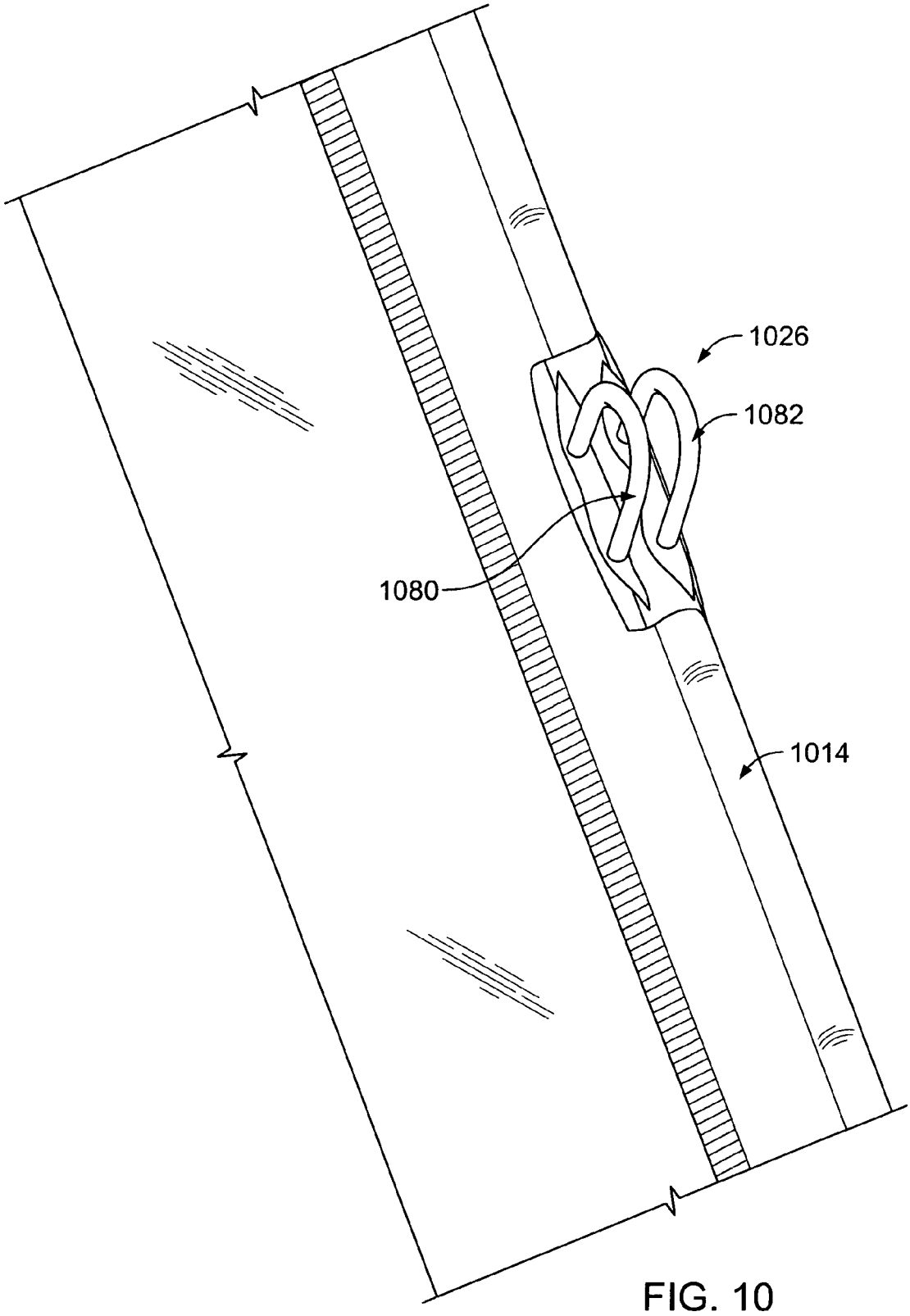
FIG. 10 is a perspective view of a portion of an assembly of panels showing a latching element.

FIG. 10 is a partial perspective view of an alternative assembly showing an alternative latching element 1026.

The illustrated latching element 1026 includes two eyelets 1080, 1082 that extend from the same panel edge 1014 as one another and in approximately the same direction as one another. As illustrated, the eyelets 1080, 1082 extend through an opening in the material that is coupled to the panel edge 1014. The eyelets 1080, 1082 define a space therebetween that is sized to frictionally engage and hold a corresponding edge of another panel. In some implementations, the eyelets 1080, 1082 may be contoured to more effectively engage and/or hold the corresponding edge of the other panel. The eyelets can be made of any rigid material, such as metal or plastic.

Figure 11:
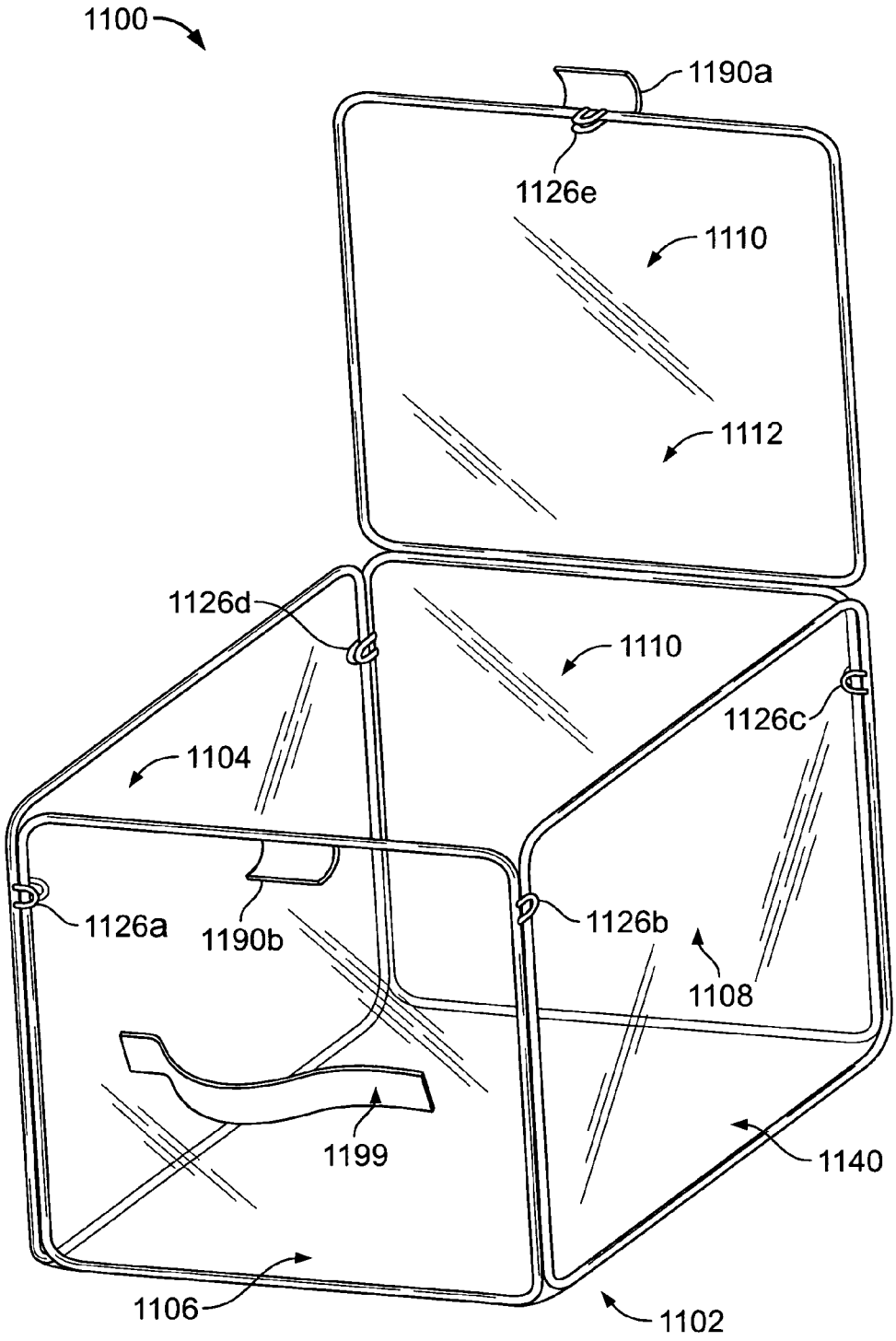
FIG. 11 is a perspective view of yet another assembly of panels foldable to form a container.

FIG. 11 is a perspective view of yet another assembly 1100 of panels foldable to form a container. The illustrated assembly 1100 is folded into a container.

The illustrated assembly 1100 has a bottom panel 1102, a top panel 1112 and four side panels 1104, 1106, 1108 and 1110. Each side panel has a respective latching element 1126*a*, 1126*b*, 1126*c*, 1126*d* that extends from an edge thereof. An edge of the top panel 1112 has one latching element 1126*e*.

The illustrated latching elements are dual eyelets (similar to the latching element 1026 shown in FIG. 10) that extend outward from the edges of the respective panels. Each latching element is configured to facilitate frictional engagement with an edge of different side panel when the assembly 1100 is folded into a container.

Typically, minimal force is required to frictionally engage a latching element with a corresponding different panel edge. In most implementations, the requisite engagement force can be readily provided by a user pushing the eyelets and edges together with their fingers. Similarly, minimal force is typically required to disengage an eyelet with a corresponding edge of a different panel. In some implementations, the requisite engagement and disengagement force can be readily provided by a person using her fingers.

In some implementations, when folded to form a container, the latching elements engage panel edges in a manner that produces an audible click. In those instances, the click may indicate to a user that the eyelet and the corresponding panel edge have been engaged properly. Once engaged, a latching element and its corresponding different panel edge tend to maintain the relative positions of the engaged panels and inhibit movement of those panels relative to one another.

Gripping elements 1190*a*, 1190*b* are respectively coupled to the top panel 1112 and the side panel 1106 near the place where latching element 1126*e* engages side panel 1106. The gripping elements may be PVC or any other kind of material that a person could grip. The gripping elements enable a user to pull top panel 1112 and side panel 1106 away from each other to disengage them from one another. Once disengaged, the top panel 912 can be opened exposing the interior of the container.

A carrying handle 1199 is attached to the outer surface of side panel 1106. The carrying handle 119 may be pvc, cloth or any other suitable material. It may be attached to the side panel 1106 with an adhesive material or with any other means known in the art.

A number of embodiments have been described. Nevertheless, it will be understood that various modifications may be made without departing from the spirit and scope of the invention.

For example, the relative sizes and shapes of the panels can be varied. The arrangement of latching elements can be varied. The frames may be a different material, such as plastic, wood, or other substantially rigid material. The material that spans the interior region defined by each frame can be, for example, paper, cardboard or other material. The method of adhering various elements to one another can vary. Other adhesive materials may be suitable. The connectors between panels can be formed in a number of ways. The physical configuration of connectors can vary as well. For example, in some implementations, the connectors are hinges.

Specific sequences of folding the various panels to form a container or a stack have been described herein. However, other variations of the sequence order are possible. Latching elements may be provided on fewer panel edges. Other types of latching elements, such as those that use hooks, hook and loop style touch fasteners, and adhesives may be used. Although the containers disclosed herein are substantially box-shaped, the containers could be different shapes.

The gripping elements could be a rigid material, such as metal, plastic, etc. The gripping elements could be formed in a variety of shapes that might facilitate gripping.

Other implementations are within the scope of the claims.

What is claimed is:

1. An assembly of panels that is foldable to form a container, the assembly comprising:

a bottom panel with four edges;

a plurality of side panels, each side panel having four edges, wherein one edge of at least some of the side panels is connected to a respective one of the bottom panel edges;

a top panel with four edges, wherein one of the top panel edges is connected to one of the side panels at a side panel edge opposite the side panel edge that is connected to the bottom panel;

respective latching elements at some of the side panel edges, wherein each latching element can be hand manipulated to engage an edge of a different side panel when the assembly of panels is folded to form the container;

a plurality of substantially rigid frames, each frame defining a respective substantially rectangular interior region and each frame corresponding to an associated bottom, top or side panel;

a material spanning across the interior region defined by each respective frame, wherein the material is folded around an edge of the respective frame and adhered to itself; and flexible connectors connecting the side panels to the bottom panel and connecting the top panel to one of the side panels;

wherein the assembly of panels is foldable to form the container while each of the side panels is connected to the bottom panel and the top panel is connected to the one of the side panels, and wherein the assembly is collapsible to form a stack of panels including the bottom panel, the top panel and the side panels while each of the side panels is connected to the bottom panel and the top panel is connected to the one of the side panels.

2. The assembly of claim 1 wherein, once engaged, each latching element can be further hand manipulated to disengage a respective edge of a different side panel.

3. The assembly of claim 1 wherein each latching element, when engaged to a corresponding edge of a different side panel, maintains a configuration between the side panel edge with the latching element and the different side panel.

4. The assembly of claim 1 wherein the frames are metallic.

5. The assembly of claim 1 wherein the material spanning across each interior region defined by the respective frames is a vinyl polymer.

6. The assembly of claim 1 wherein the material spanning across each interior region defined by the respective frames is substantially transparent.

7. The assembly of claim 1 wherein the flexible connectors are made of a vinyl polymer material.

8. The assembly of claim 1 wherein each latching element is adapted to frictionally engage the edge of the different side panel when the assembly of panels is folded to form the container.

9. The assembly of claim 8 wherein the latching elements comprise one or more eyelets.

10. The assembly of claim 1 wherein each latching element comprises a magnet.

11. The assembly of claim 10 wherein each of the latching elements is adapted to magnetically engage an edge of the respective side panel when the assembly of panels is folded to form the container.

12. The assembly of claim 1 further comprising a latching element on the top panel to engage an edge of the side panel that is connected to a side of the bottom panel opposite the top panel.

13. The assembly of claim 1 further comprising a side panel connected to a far edge of the top panel relative to the bottom panel.

14. The assembly of claim 1 including four side panels each of which has a plurality of latching elements on at least one of its edges, wherein the latching elements comprise eyelets that extend outward from the respective edges of the side panels for engagement with an edge of a different side panel when the assembly is folded into the container.

15. An assembly of panels that is foldable to form a container, the assembly comprising:

a bottom panel with four edges;

a plurality of side panels, each side panel having four edges, wherein one edge of at least some of the side panels is connected to a respective one of the bottom panel edges;

a top panel with four edges, wherein one of the top panel edges is connected to an edge of one of the side panels opposite the side panel edge that is connected to the bottom panel; and flexible connectors connecting the side panels to the bottom panel and connecting the top panel to at least one of the side panels;

wherein each of the bottom panel, top panel and side panels respectively comprises:

a substantially rigid frame defining a substantially rectangular interior region; and a substantially transparent material spanning across each interior region, wherein the frame of at least some of the side panels includes a latching element that can be hand manipulated to engage an edge of another side panel when the assembly of panels is folded to form the container, wherein engagement of the latching element to an edge of another side panel creates an audible click, wherein the assembly of panels is foldable to form the container while each of the side panels is connected by respective ones of the flexible connectors to the bottom panel and the top panel is connected by one of the flexible connectors to the one of the side panels, and wherein the assembly is collapsible to form a stack of panels including the bottom panel, the top panel and the side panels while each of the side panels is connected by respective ones of the flexible connectors to the bottom panel and the top panel is connected by one of the flexible connectors to the one of the side panels.

16. The assembly of claim 15 wherein, once engaged, the latching element can be hand manipulated to disengage the respective edge of a different side panel.

17. The assembly of claim 15 wherein the latching element, when engaged to the edge of the different one of the side panels, is adapted to maintain relative positioning of the side panel edge having the latching element and the side panel to which it is engaged.

18. The assembly of claim 15 wherein the flexible connectors are made of a vinyl polymer material.

19. An assembly of panels that is foldable to form a container, the assembly comprising:

a bottom panel with four edges;

a plurality of side panels, each side panel having four edges, wherein one edge of at least some of the side panels is connected to a respective one of the bottom panel edges;

a top panel with four edges, wherein one of the top panel edges is connected to an edge of one of the side panels opposite the side panel edge that is connected to the bottom panel; and flexible connectors connecting the side panels to the bottom panel and connecting the top panel to at least one of the side panels;

wherein each of the bottom panel, top panel and side panels respectively comprises:

a substantially rigid frame defining a substantially rectangular interior region; and a substantially transparent material spanning across each interior region, wherein the frame of at least some of the side panels and the top panel includes a latching element that can be hand manipulated to engage an edge of a side panel when the assembly of panels is folded to form the container;

wherein engagement of the latching element to an edge of a side panel creates an audible click;

wherein, once engaged, the latching element can be hand manipulated to disengage the respective edge of a side panel; and wherein the latching element is an eyelet that extends from its respective side panel or top panel in a direction that is substantially perpendicular to the plane of the associated side panel or top panel.

20. The assembly of claim 19 wherein the material spanning across each interior region defined by the respective frames is a vinyl polymer.

* * * * *